US005692240A

United States Patent [19]

Steele

[11] Patent Number: 5,692,240

[45] Date of Patent: Dec. 2, 1997

[54] ADJUSTABLE SHIRT COLLAR DEVICE

[76] Inventor: James Stanley Steele, 6121 NE. Lessard Rd., Camas, Wash. 98607

[21] Appl. No.: 630,500

[22] Filed: Apr. 10, 1996

[51] Int. Cl.[6] ..... A41B 3/02

[52] U.S. Cl. ..... 2/129; 2/141.2; 2/128; 2/912

[58] Field of Search ..... 2/127, 128, 129, 2/141.1, 141.2, 912, 913, 158, 159

[56] References Cited

U.S. PATENT DOCUMENTS

| | | | |
|---|---|---|---|
| 2,086,907 | 7/1937 | Goldschmidt | 2/69 |
| 5,274,853 | 1/1994 | Millican | 2/141.1 |
| 5,515,547 | 5/1996 | Middleton | 2/158 |

*Primary Examiner*—C. D. Crowder
*Assistant Examiner*—Shirra L. Jenkins
*Attorney, Agent, or Firm*—William A. Birdwell & Associates

[57] ABSTRACT

A method and apparatus for adjusting a collar. A flexible fastener is attached to a first side of a neck-band, underneath an under collar and out of sight, and removably attached to a second side of the neck-band, also underneath the under collar and out of sight, for adjustably fastening the collar. The flexible fastener may be detached from the first side of the neck-band and removably attached to the second side of the neck-band, also underneath the under collar and out of sight, for stowing the fastener out of sight when it is desired to wear the collar open.

7 Claims, 2 Drawing Sheets

ADJUSTABLE SHIRT COLLAR DEVICE

BACKGROUND OF THE INVENTION

2. Field of the Invention

This invention relates to a device for closing and adjusting the neckband of a shirt or other article of clothing.

2. Description of the Prior Art

Shirts, in particular dress shirts, and other articles of clothing are manufactured in standard collar sizes that fasten with a stationary button. This leaves no way of adjusting the shirt, or other collar, to fit individual neck sizes. This causes discomfort for any individual who falls between sizes or has a weight gain. In addition, if an article becomes uncomfortable with wear there is no way to make an adjustment and still look appropriate in a work or social setting.

SUMMARY OF THE INVENTION

The invention relates to a device that replaces the stationary neckband button with adjustable hook and loop fasteners adapted for removably attaching to one another, such as two mating portions of VELCRO, one attached to each side of the neckband. This would allow the individual to adjust the shirt or other collar to his or her exact size to ensure a comfortable fit. A third hook and loop fastener strip is attached to the under collar which allows the covering strip to be retracted and attached for concealment if the shirt is worn open.

The object of the invention is to ensure a comfortable fitting neckband, both initially and for long term wear. This would allow the wearer to be more comfortable and at ease in stressful work or social settings.

(PREFERRED EMBODIMENTS)

Figure 1:
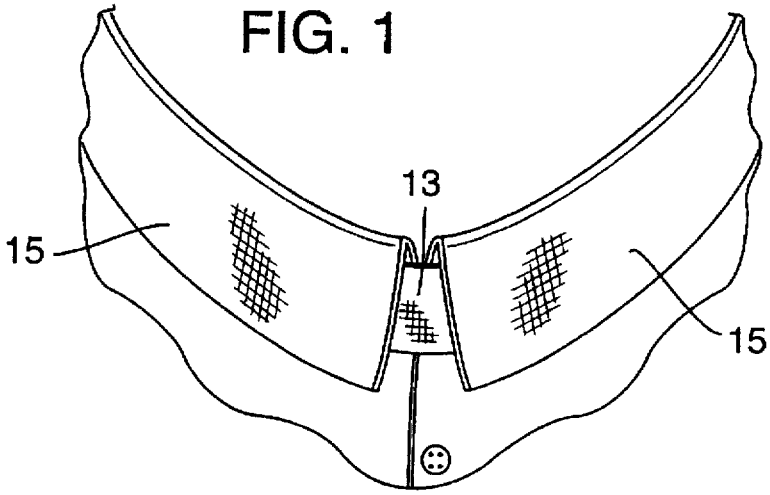
FIG. 1 is a from elevation of a shirt collar with an adjustable shin collar device according to the present invention in a fastened configuration.
Figure 2:
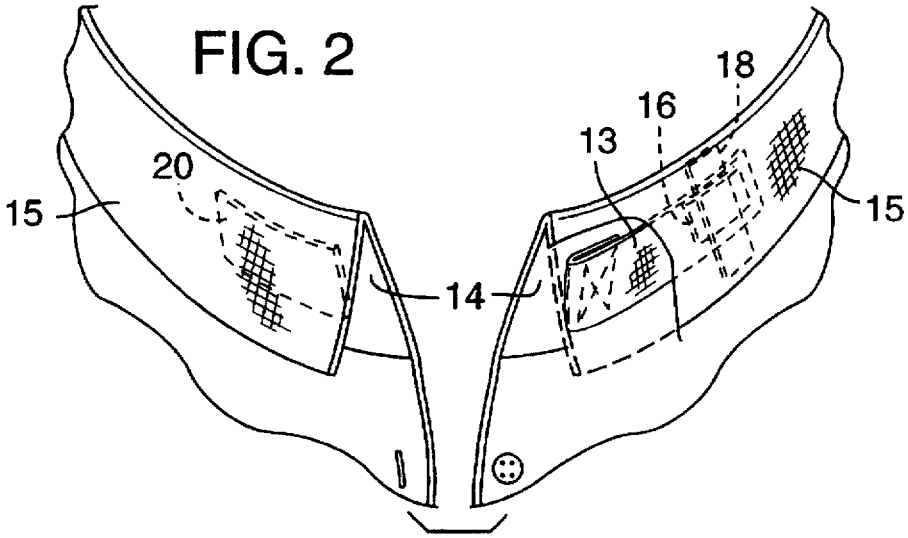
FIG. 2 is a front elevation of the shirt collar of FIG. 1 in an open configuration with the device of FIG. 1 retracted.
Figure 3:
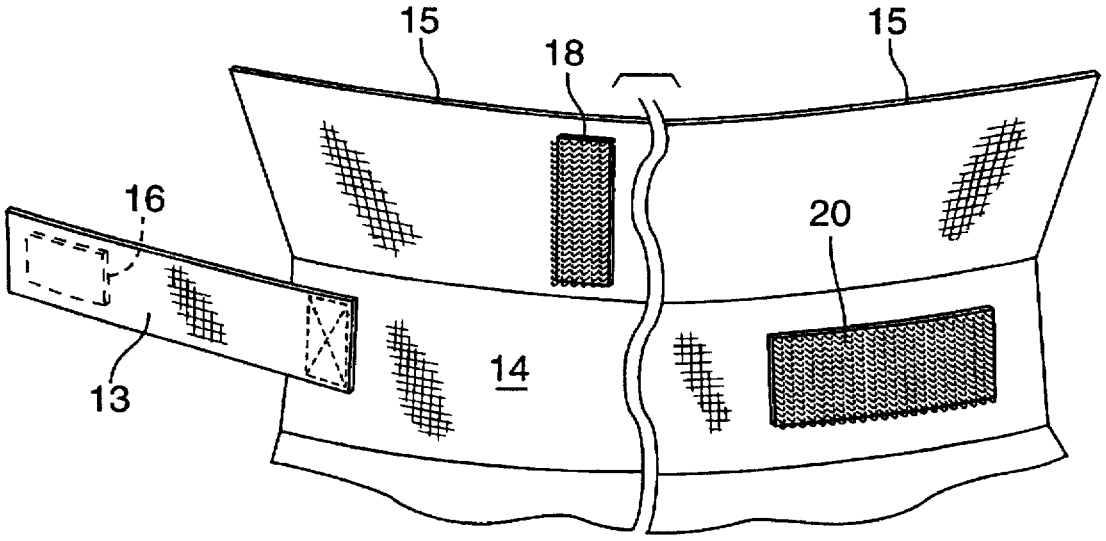
FIG. 3 is a rear elevation the shirt collar and device of FIG. 1 and the device of FIG. 1 in an unfastened configuration.
Figure 4:
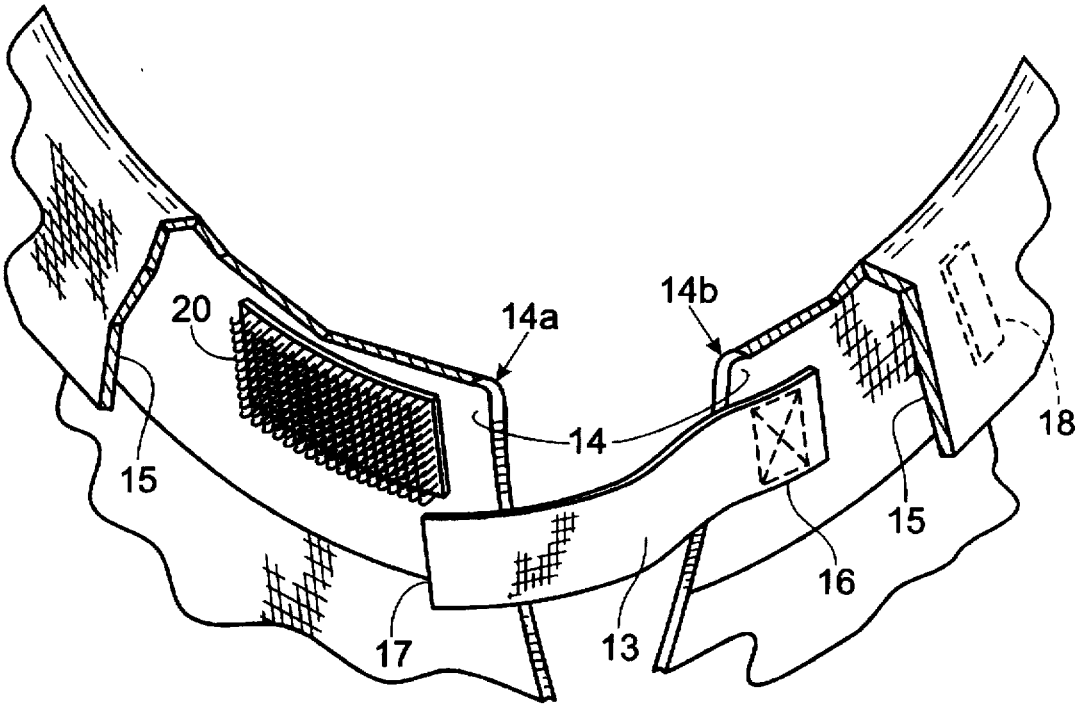
FIG. 4 is a front elevation of the shirt collar and device of FIG. 3.
Figure 5:
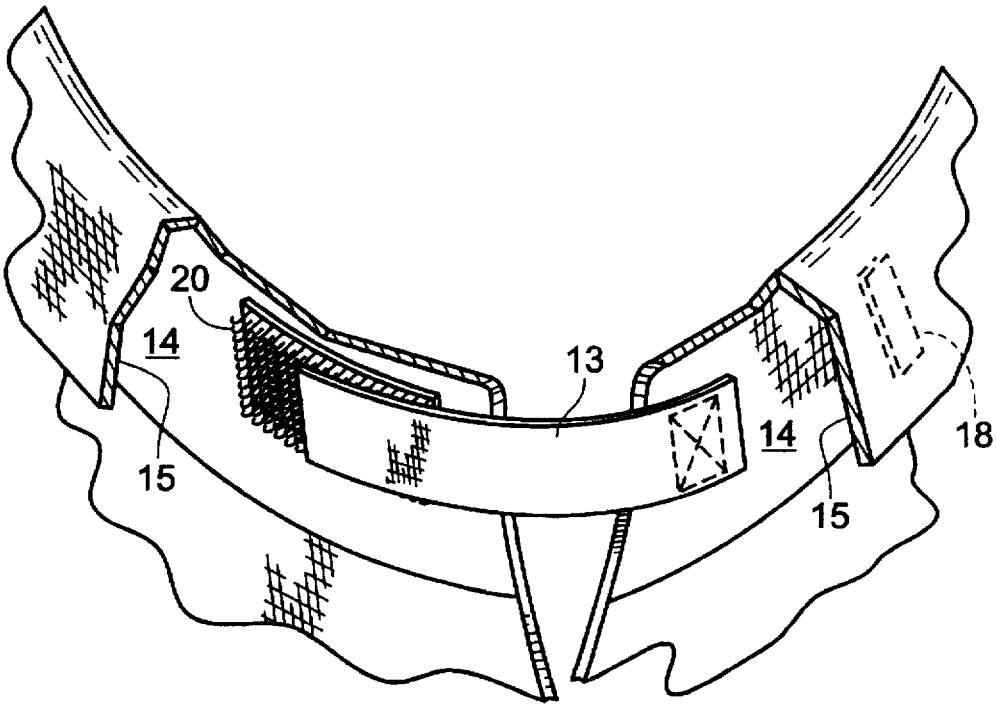
FIG. 5 is a partially cut-away, from elevation of the shirt collar and device of FIG. 1.

The embodiment of this invention consists of a first strip, 13, of hook and loop fastener located on a flexible fastener and a first mating strip of hook and loop fastener, 20, approximately three to three and one half inches in length, by one quarter to one half inches wide being attached to each side 14*a*, 14*b* of the neckband 14 of a man's shirt, or other article of clothing, with thread or another fastening material. One strip 13 may be covered with fabric from the article of clothing, and the fabric may be of any design the manufacturer would choose to use for decoration or fashion. The flexible fastener has a first end, 16, fixedly attached to the first side, 14*b*, of the neckband to form a first attachment and a second end, 17 adapted for removable attachment to a second side, 14*a*, of the neckband, 14, to form a second attachment.

The hook and loop fastener strips are attached at or near the union of the neckband and the under collar 15. The shirt fabric is stitched, or otherwise bonded, to the non-adhering side of the top hook and loop fastener strip 13 having an approximate one half to one inch strip of the shirt fabric extending past the end of the hook and loop fastener for seam allowance.

The top (or covering) hook and loop fastener strip is then attached to the "right side out" of the neckband, using the seam allowance. It is essential that the seam be set back approximately one and one half to two inches from the edge of the neckband opening to ensure concealment. A third piece of hook and loop fastener strip 18 which is adapted to be removeably attached to fastener strip 13 to form a third attachment, approximately one quarter inch wide by three quarter inches long is attached to the under collar, approximately four inches from the front edge of the under collar. This is done prior to the under collar being stitched to the collar facing.

The first (or covering) hook and loop fastener strip 13 can then be bent back and attached to the second mating strip hook and loop fastener strip 18 for concealment when a shirt, or other article of clothing, is worn open.

The Adjustable Shirt Collar Device can be manufactured and marketed as a part of a shirt or other article of clothing. It may be manufactured and marketed as a separate package for converting any existing shirt or other article of clothing to an adjustable neck opening.

If the Adjustable Shirt Collar Device were manufactured and marketed on an object of clothing other than a man's shirt, some adjustments would need to be made such as: Length and width of the hook and loop fastener strips 13, 20. Length of setback on the neckband for the shirt material covering strip. Size of the hook and loop fastener strip 18 that is attached to the under collar.

All embodiments of this invention would function to make a neck collar closure that ensures an initial exact fit and is adjustable at any time for comfort.

I claim:

1. An apparatus for adjusting a collar having a neckband with opposed first and second sides forming a dollar opening space there between, comprising:

a flexible fastener having first and second ends;

a first attachment adapted for fixedly attaching said first end of said fastener to the first side of the neckband;

a second attachment adapted for removably attaching said second end of said fastener to the second side of the neckband; and a third attachment adapted for removably attaching said second end of said fastener to the first side of the neckband so that, when said fastener is attached to said third attachment, said fastener is stowed away from the collar opening space.

2. The apparatus of claim 1, wherein the collar includes a portion folded over the neckband, the portion having an under collar surface which lies adjacent the neckband, wherein said first, second and third attachments are disposed on the neckband so as to be substantially hidden from view behind the under collar surface.

3. The apparatus of claim 2, wherein said third attachment is spaced-apart from said first attachment so as to hold said fastener behind the under collar surface so that said fastener is substantially hidden from view when said fastener is attached to said third attachment.

4. The apparatus of claim 1, wherein said fastener includes, at said second end, a first strip of a hook and loop fastener, and wherein said second attachment includes a first mating strip of said hook and loop fastener adapted to removably attach to said first strip.

5. The device of claim 3, wherein said third attachment includes a second mating strip of said hook and loop fastener adapted to removably attach to said first strip.

6. The device of claim 1, wherein said fastener includes a covering of fabric.

7. A method for adjusting a collar having a neckband with opposed first and second sides forming a collar opening space therebetween, comprising:

providing a fastener having first and second ends;

attaching said first end of said fastener to a first attachment on the first side of the neckband;

attaching a second attachment to the second side of the neckband, said second attachment being adapted to removably attach to said fastener; and attaching a third attachment to the first side of the neckband, said third attachment being spaced from said first attachment and being adapted to removably attach to said fastener, wherein, when said fastener is attached to said third attachment, said fastener is stowed away from the collar opening space.

* * * * *